US006649846B2

(12) United States Patent
Chi-Sheng et al.

(10) Patent No.: US 6,649,846 B2
(45) Date of Patent: Nov. 18, 2003

(54) ELECTRICAL DEVICE HAVING INSULATING STRUCTURE

(75) Inventors: Chen Chi-Sheng, Taoyuan Hsien (TW); Hsieh Tung-Yun, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/247,700

(22) Filed: Sep. 19, 2002

(65) Prior Publication Data

US 2003/0127243 A1 Jul. 10, 2003

(30) Foreign Application Priority Data

Apr. 1, 2002 (TW) ..... 91204134 U

(51) Int. Cl.[7] ..... H01B 17/00
(52) U.S. Cl. ..... 174/148; 174/137 R; 174/138 R
(58) Field of Search ..... 174/137 R, 138 R, 174/138 E, 138 G, 146, 148, 151

(56) References Cited

U.S. PATENT DOCUMENTS 3,770,878 A * 11/1973 Dozier ..... 174/153 R
3,854,374 A * 12/1974 Boyle et al. ..... 411/80.1
4,889,502 A * 12/1989 Althouse et al. ..... 439/607
6,333,855 B2 * 12/2001 Prabaonnaud et al. ..... 361/758
6,424,538 B1 * 7/2002 Paquin ..... 361/752

* cited by examiner

*Primary Examiner*—Dean A. Reichard
*Assistant Examiner*—Jinhee Lee
(74) *Attorney, Agent, or Firm*—Michael Best & Friedrich LLC

(57) ABSTRACT

The present invention relates to an electrical device having an insulating structure. The electrical device includes an electrical device body, a shell having a bottom surface and containing the electrical device body therein, a first insulating element disposed between the electrical device body and the bottom surface of the shell, and a second insulating element disposed below the shell for cooperating with the first insulating element to interpose the shell between the first insulating element and the second insulating element, so as to insulate the electrical device.

2 Claims, 7 Drawing Sheets

ELECTRICAL DEVICE HAVING INSULATING STRUCTURE

FIELD OF THE INVENTION

The present invention is related to an electrical device and more particularly, to an electrical device having an insulating structure.

BACKGROUND OF THE INVENTION

In an electrical device of the prior art, the outer shell is usually made of a metal for protecting the inner part of the electrical device. Although the outer shell made of a metal can protect the outer structure and the inner element of the electrical device, it also induces the electric leakage in the electrical device while the electrical device is operated. That would reduce the life of the electrical device or other peripheral devices.

Please refer to FIG. 1. It illustrates a power factor regulator of the prior art. Typically, a power factor regulator includes an electrical device body 11 and a shell 12 containing the electrical device body 11 therein. The shell 12 is made of metal and has two extended parts 121 extending from the bottom of the shell 12. Each of the extended parts further has plural threaded holes 122 for fastening the electrical device. However the shell 12 of the power factor regulator, the extended parts 121 and the fixing screws are all made of metals. Also, metal is able to conduct electricity. Hence, the structure of the prior power factor regulator would induce the electric leakage, then damage the electrical device and the other peripheral devices. Furthermore, if the main fixing board is also made of metal, the electric leakage would be induced more seriously while the electrical device is fixed on the main fixing board.

Therefore, it is tried to rectify this drawback and provide an electrical device having an insulating structure by the present applicant.

SUMMARY OF THE INVENTION

It is therefore a primary objective of the present invention to provide an electrical device having an insulating structure. The electrical device includes an electrical device body, a shell having a bottom surface and containing the electrical device body therein, a first insulating element disposed between the electrical device body and the bottom surface of the shell, and a second insulating element disposed below the shell for cooperating with the first insulating element to interpose the shell between the first insulating element and the second insulating element, so as to insulate the electrical device.

Certainly, the first insulating element and the second insulating element can be made of an insulating material.

Certainly, the second insulating element can be an adhesive tape.

Certainly, the second insulating element can be an insulating slice.

Certainly, the second insulating element can be a silica gel.

Certainly, the second insulating element can be an air layer and the first insulating element includes at least an extending part extended downwardly beyond the bottom surface of the shell, so as to insulate the electrical device via the extending part.

Preferably, the extending part further includes plural threaded holes for fastening thereto the electrical device.

Preferably, the bottom surface of the shell has a side cutout for protruding thereunder the extending part and upwardly raising the electrical device.

Preferably, the bottom surface further includes plural openings for passing therethrough the extending part, therebeyond for upwardly raising the electrical device.

Preferably, the first insulating element further includes two limiting parts extended upwardly respectively from two sides of the first insulating element for fastening the electrical device.

Preferably, the electrical device is one selected from a group consisting of a power factor regulator, a PFC and a transformer.

Preferably, the power factor regulator further includes a coil sleeve, and an iron core sleeved in the coil sleeve.

Certainly, the coil sleeve can be made of an insulating material.

Certainly, the coil sleeve and the first insulating element can be of a unity.

Preferably, the first insulating element and the second insulating element respectively includes plural threaded holes for fastening the electrical device.

The foregoing and other features and advantages of the present invention will be more clearly understood through the following descriptions with reference to the drawings, wherein:

DETAILED DESCRIPTION OF THE PREFERRED EMBODIMENTS

Figure 1:
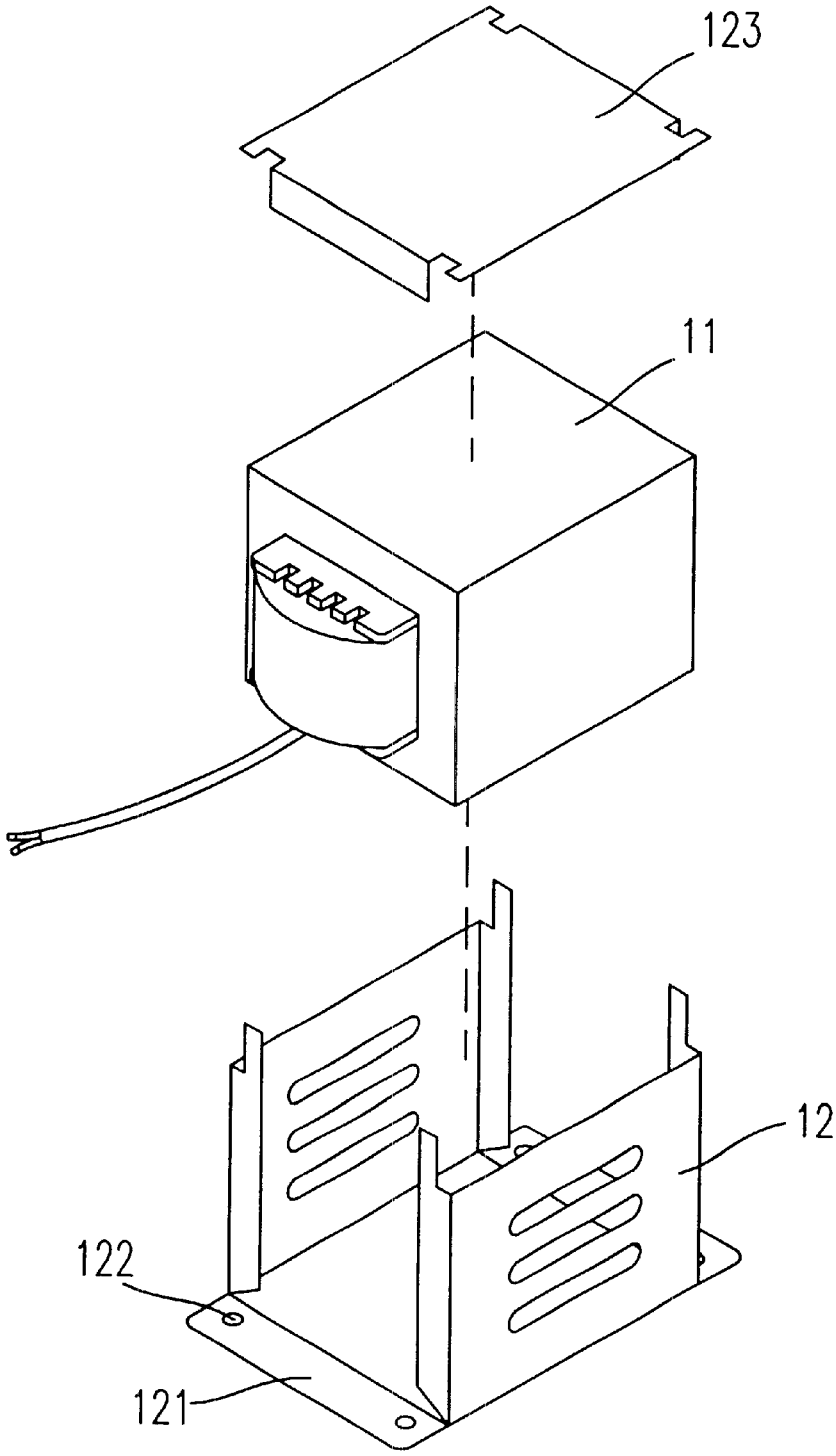
Fig. 1(PRIOR ART)
FIG. 1 illustrates a power factor regulator of the prior art.
Figure 2:
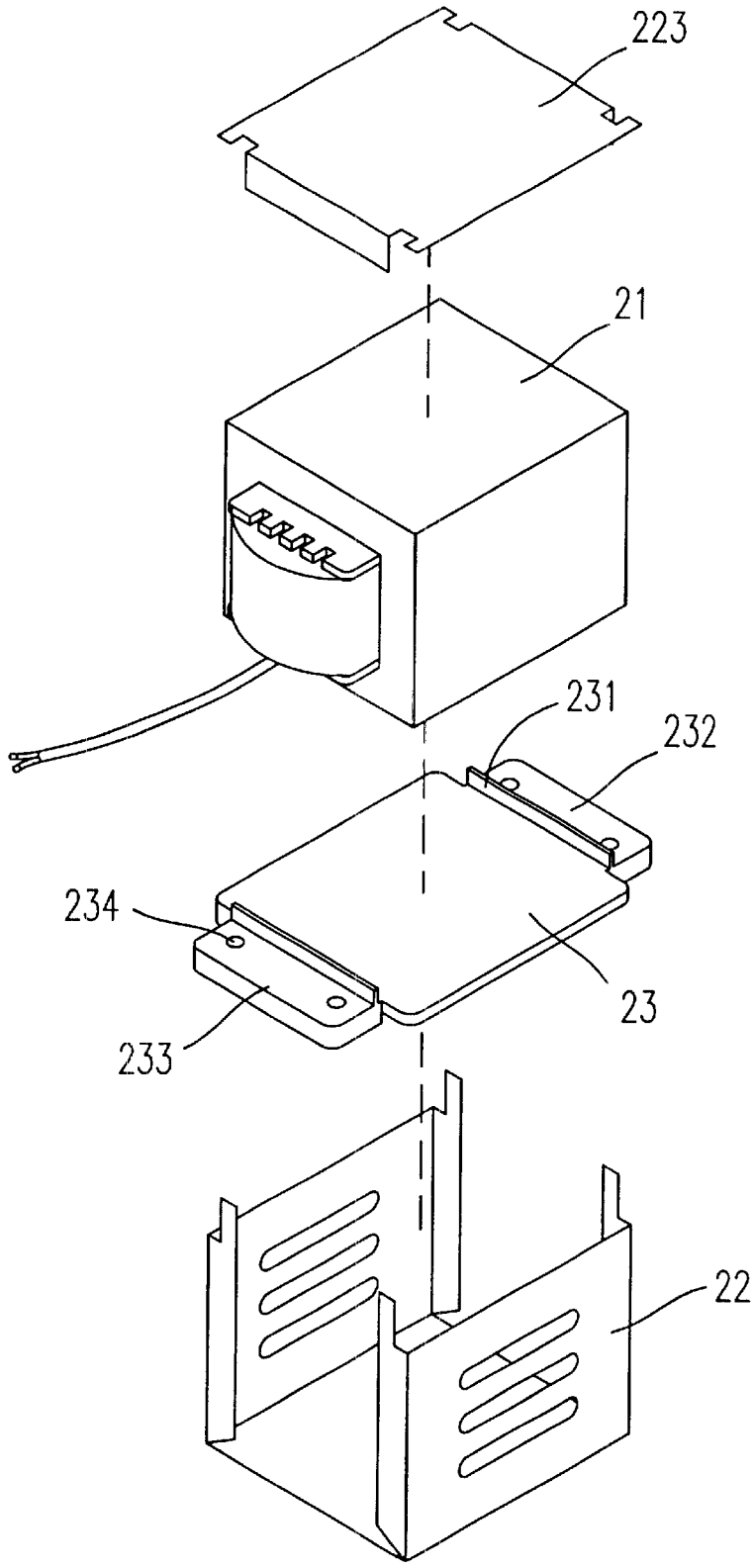
FIG. 2 illustrates a first preferred embodiment of the present invention of a power factor regulator.

Please refer to FIG. 2. It illustrates a preferred embodiment of the present invention of a power factor regulator. The electrical device having an insulating structure includes an electrical device body 21, a shell 22 having a bottom surface and containing the electrical device body 21 therein, a first insulating element 23 disposed between the electrical device body 21 and the bottom surface of the shell 22, and a second insulating element (not shown) disposed below the shell 22 for cooperating with the first insulating element 23 to interpose the shell 22 between the first insulating element 23 and the second insulating element, so as to insulate the electrical device. Meanwhile, the second insulating element is an air layer and the first insulating element 23 includes at least an extending part 232, 233 extended downwardly beyond the bottom surface of the shell 22, so as to insulate the electrical device via the extending part 232, 233. The first insulating element is made of an insulating material. The extending part further includes plural threaded holes 234 for fastening thereto the electrical device. And the first insulating element 23 further includes two limiting parts 231 extended upwardly respectively from two sides of the first insulating element 23 for fastening the electrical device. Certainly, the insulating structure can be implemented in a PFC and a transformer.

Figure 3:
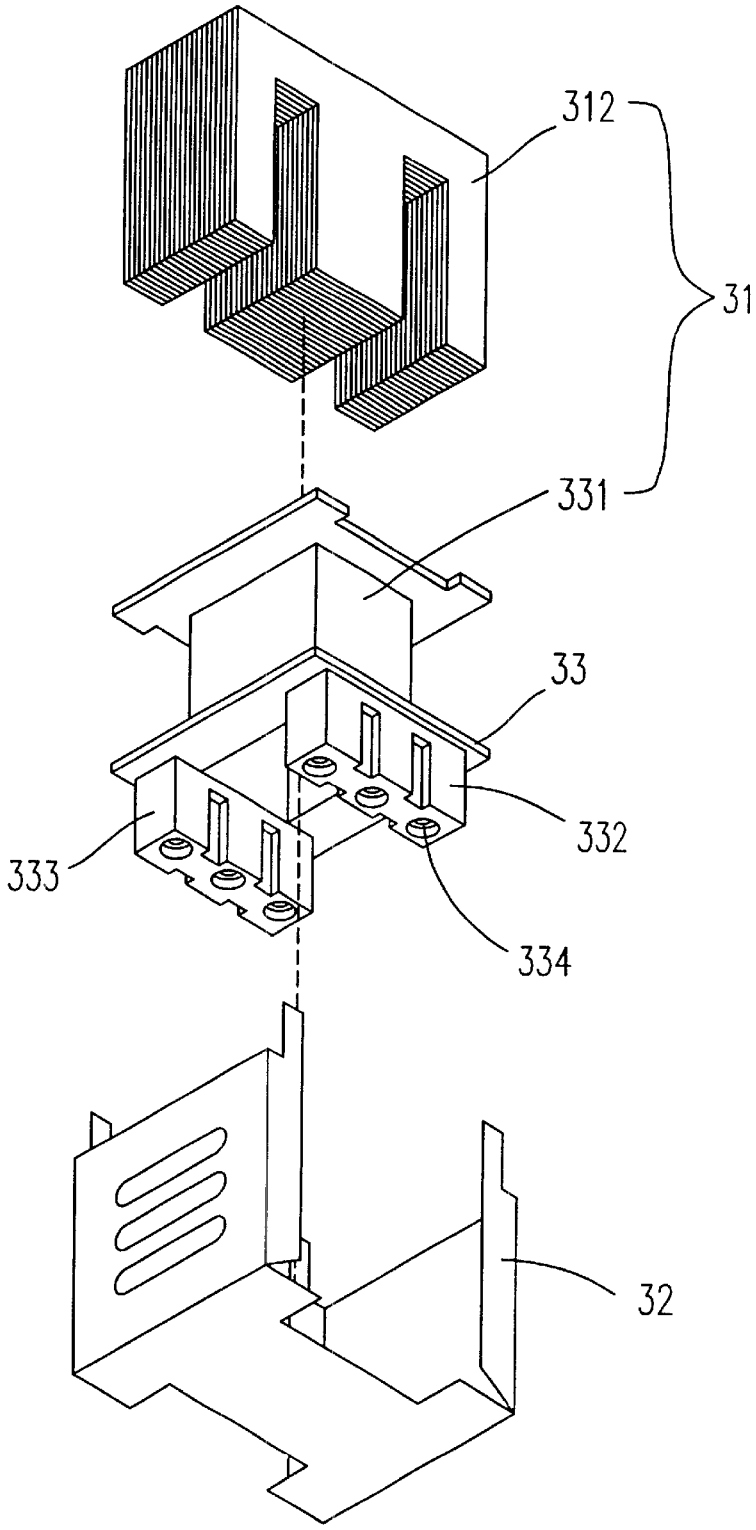
FIG. 3 illustrates a second preferred embodiment of the present invention of a power factor regulator.
Figure 4:
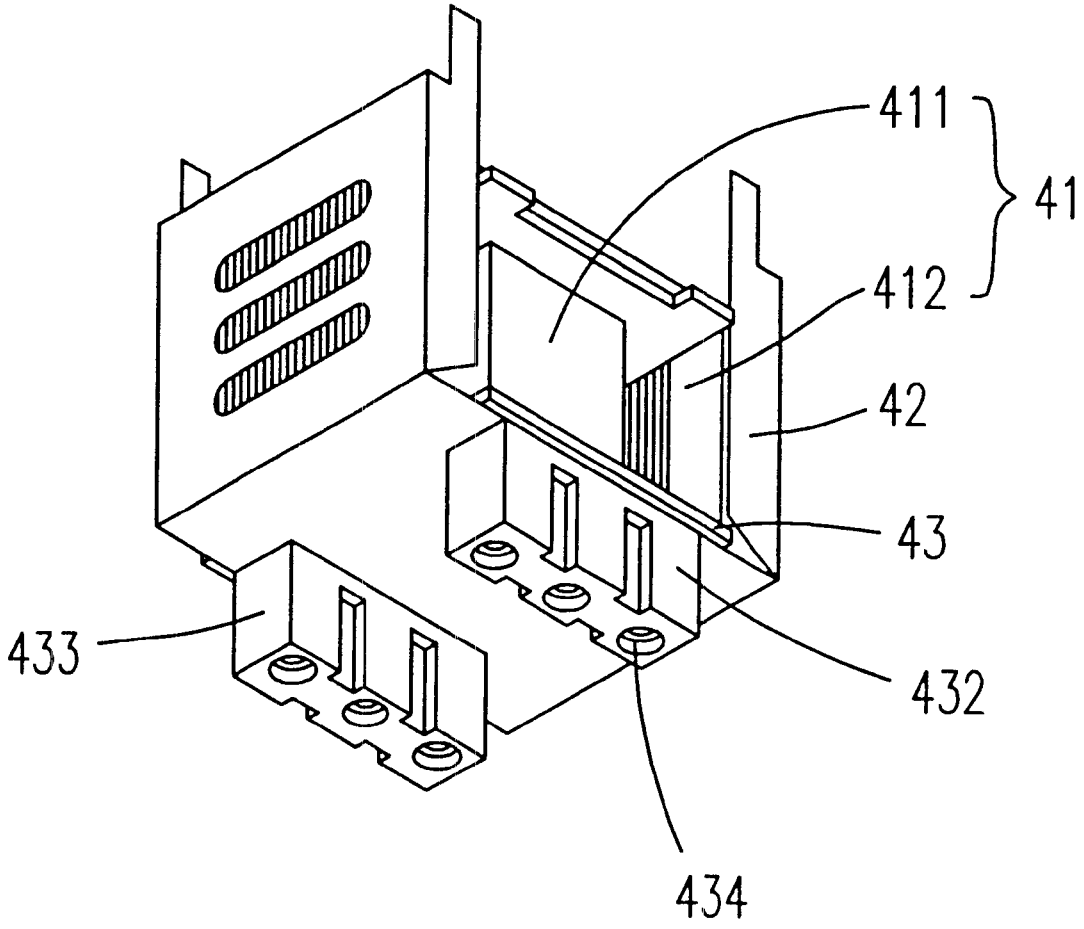
FIG. 4 illustrates a combined structure of FIG. 3.

FIG. 3 illustrates a second preferred embodiment of the present invention of a power factor regulator. The electrical device includes an electrical device body 31, a shell 32 having a bottom surface and containing the electrical device body 31 therein, a first insulating element 33 disposed between the electrical device body 31 and the bottom surface of the shell 32, and a second insulating element (not shown) disposed below the shell 32 for cooperating with the first insulating element 33 to interpose the shell 32 between the first insulating element 33 and the second insulating element, so as to insulate the electrical device. Meanwhile, the second insulating element is an air layer and the first insulating element 33 includes at least an extending part 332 extended downwardly beyond the bottom surface of the shell 32, so as to insulate the electrical device via the extending part 332. Furthermore, the bottom surface of the shell 32 has a side cutout for protruding thereunder the extending part 332 and upwardly raising the electrical device. The power factor regulator further includes a coil sleeve 331 and an iron core 312 sleeved in the coil sleeve 331, wherein the coil sleeve 331 and the first insulating element 33 are of a unity made of an insulating material. The extending part 332 further includes plural threaded holes 334 for fastening thereto the electrical device. FIG. 4 illustrates a combined structure of FIG. 3.

Figure 5:
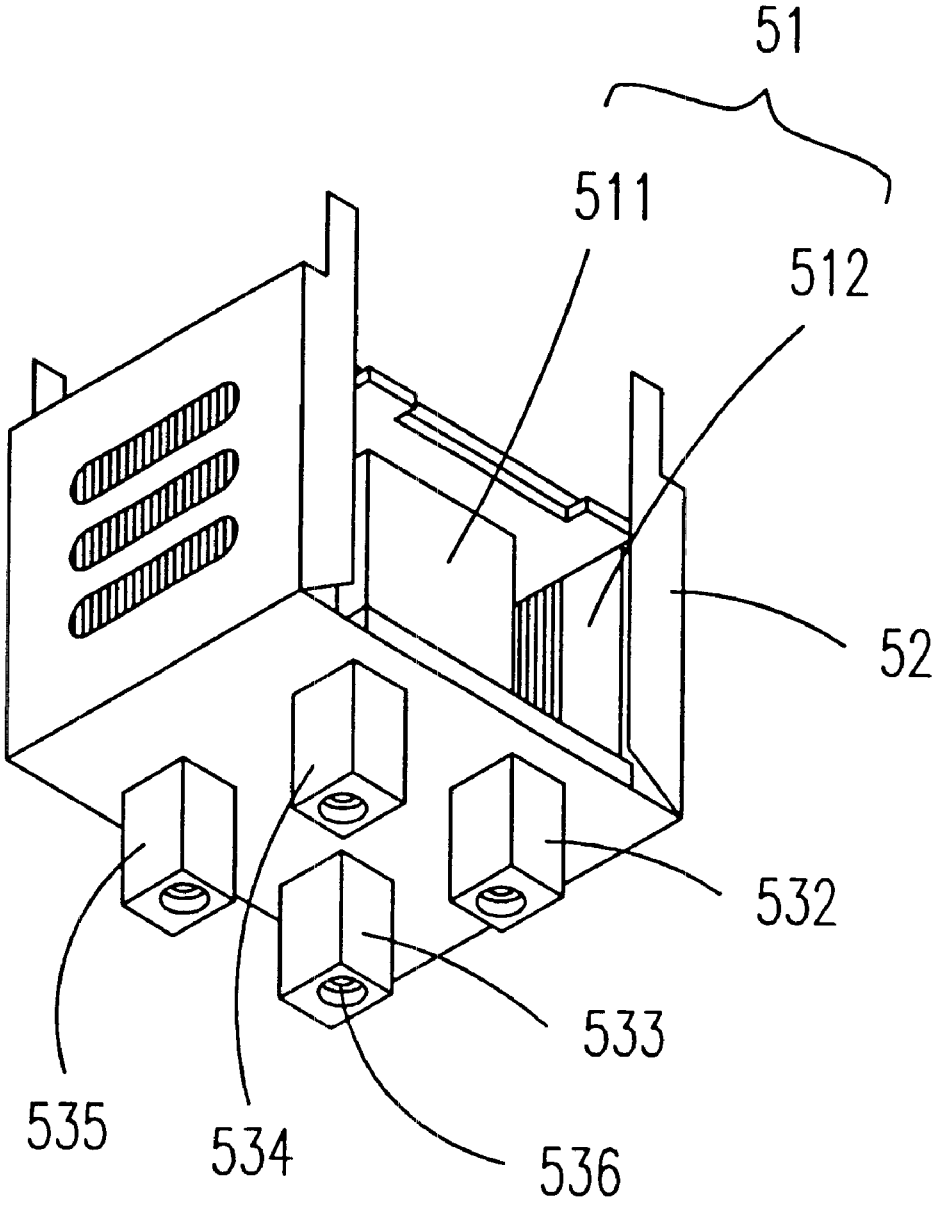
FIG. 5 illustrates a third preferred embodiment of the present invention of a power factor regulator.

FIG. 5 illustrates a third preferred embodiment of the present invention of a power factor regulator. The electrical device includes an electrical device body 51, a shell 52 having a bottom surface and containing the electrical device body 51 therein, a first insulating element 53 disposed between the electrical device body 51 and the bottom surface of the shell 52, and a second insulating element (not shown) disposed below the shell 52 for cooperating with the first insulating element 53 to interpose the shell 52 between the first insulating element 53 and the second insulating element, so as to insulate the electrical device. Meanwhile, the second insulating element is an air layer and the first insulating element 53 includes at least an extending part 532, 533, 534, 535 extended downwardly beyond the bottom surface of the shell 52, so as to insulate the electrical device via the extending part 532, 533, 534, 535. Furthermore, the bottom surface of the shell 52 further includes plural openings for passing therethrough the extending part 532, 533, 534, 535 therebeyond for upwardly raising the electrical device.

Figure 6:
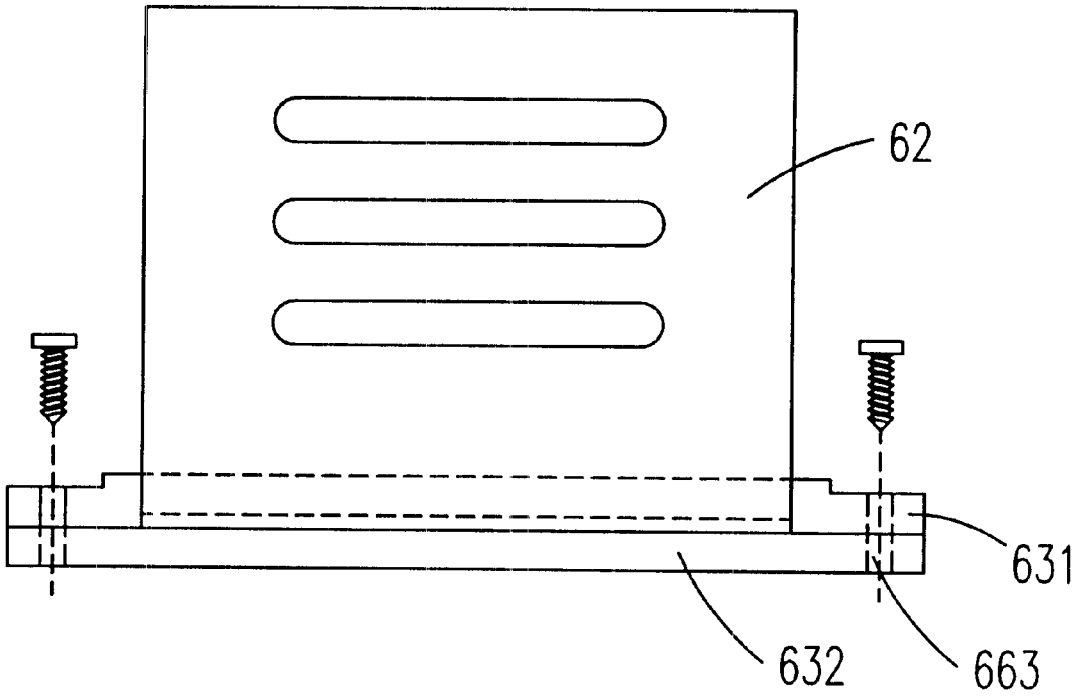
FIG. 6 illustrates fourth preferred embodiment of the present invention of a power factor regulator.
Figure 7:
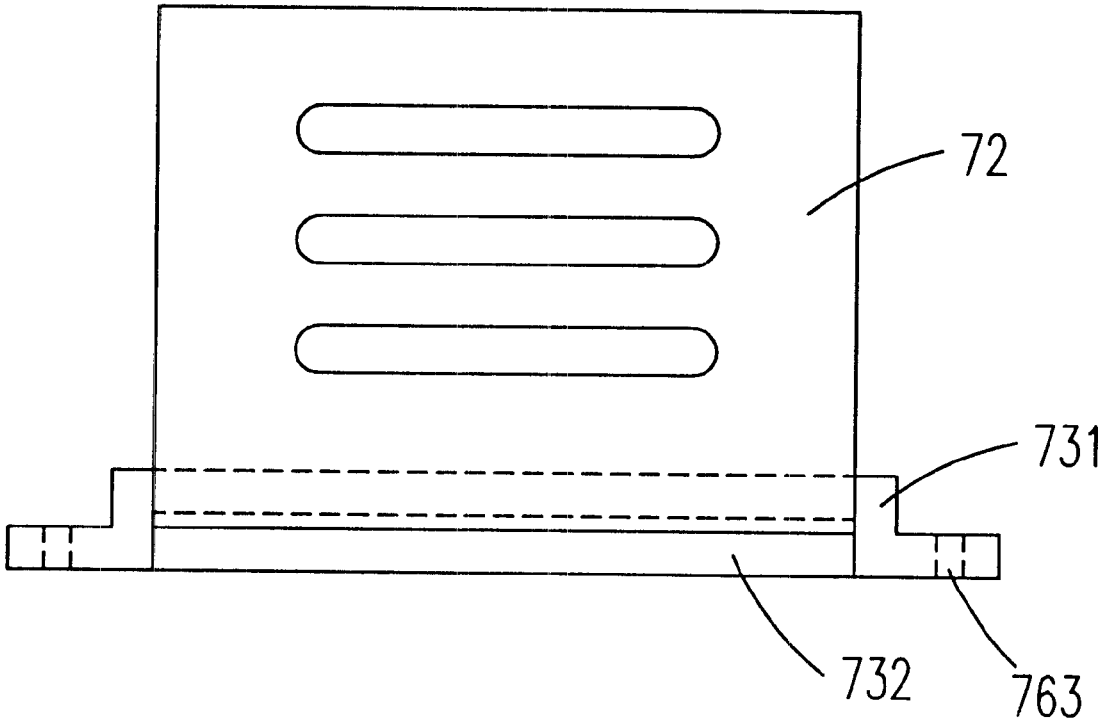
FIG. 7 illustrates fifth preferred embodiment of the present invention of a power factor regulator.

FIGS. 6 and 7 respectively illustrate a fourth and a fifth preferred embodiments of the present invention of power factor regulators. Meanwhile, the first insulating element 631, 731 and the second insulating element 632, 732 are made of an insulating material. Certainly, the second insulating element can be one selected from a group consisting of an adhesive tape, an insulating slice and a silica gel. Also, the first insulating element 631, 731 and the second insulating element 632, 732 respectively includes plural threaded holes for fastening the electrical device.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electrical device having an insulating structure comprising:

an electrical device body;

a shell having a bottom surface and containing said electrical device body therein;

a first insulating element disposed between said electrical device body and said bottom surface of said shell;

a second insulating element disposed below said shell for cooperating with said first insulating element to interpose said shell between said first insulating element and said second insulating element, so as to insulate said electrical device;

wherein said second insulating element is an air layer and said first insulating element includes at least an extending part extended downwardly beyond said bottom surface of said shell so as to insulate said electrical device via said extending part, and said extending part further comprises plural threaded holes for fastening thereto said electrical device.

2. The electrical device according to claim 1 wherein said first insulating element is made of an insulating material.

* * * * *